US005996443A

United States Patent [19]

Gold

[11] Patent Number: 5,996,443

[45] Date of Patent: Dec. 7, 1999

[54] FASTENER HOLDING DEVICE

[75] Inventor: Laurence H. Gold, Takoma Park, Md.

[73] Assignee: Kidshop, Inc., Takoma Park, Md.

[21] Appl. No.: 09/081,651

[22] Filed: May 20, 1998

[51] Int. Cl.[6] ..... B25C 3/00

[52] U.S. Cl. ..... 81/44

[58] Field of Search ..... 81/44, 487, 23

[56] References Cited

U.S. PATENT DOCUMENTS 4,691,598 9/1987 Lin ..... 81/44

*Primary Examiner*—D. S. Meislin

[57] ABSTRACT

A device for holding a fastener in a position to facilitate penetration of the fastener or a nail into an underlying surface, which includes a handle portion and a head portion. The head portion of the device contains aligned apertures through which the fastener is retained while being driven into the underlying surface.

7 Claims, 2 Drawing Sheets

FASTENER HOLDING DEVICE

FIELD OF THE INVENTION

This invention relates to fastener holders and more particularly it relates to a device which may be handily used to assist in holding a fastener, such as a nail, in position as it is being driven into an underlying surface.

BACKGROUND OF THE INVENTION

It is awkward and often dangerous to attempt to hold a nail in place with one hand while using a hammer in the other hand to strike the nail and drive it into a desired position in an underlying surface. Many a thumb has been smashed by persons attempting that exact procedure. Moreover, if such a procedure offers dangers to adults, it offers considerably more dangers to children who are not as skilled or dextrous in the use of hand tools.

In recognition of the problems in trying to digitally grasp and hold a nail while it is being driven, there have been many attempts in the prior art to provide nail holders which will serve the purpose of holding the nail in some form of tool or device while the user hammers the nail into position. Some of these prior art attempts are disclosed in U.S. Patents, as noted hereinafter.

In U.S. Pat. No 3,060,442, issued Oct. 30, 1962 to R. Tomek, there is disclosed a nail holder having an open end with a slit therein to form a pair of confronting jaws. Each jaw has a semi-cylindrical recess formed therein and the pair of jaws form a cylindrical recess into which a nail to be driven is inserted and held. Once the nail is partially driven, the holder is slid away to permit the nail to exit through the open end of the holder.

In U.S. Reissue Pat. No. 28,159 issued Sep. 17, 1974 to J. Litz, there is disclosed a nail holder which has a flat portion created by two spaced parallel walls, with a resilient material sandwiched therebetween. Preformed holes extend through the walls and the resilient material, with each hole having a communicating side slot. In use, the nail to be drive is inserted into a preselected hole where it is held in position by the resilient sandwiched material. Once the nail is partially driven, the holder is moved toward the side, to slide the exposed nail portion through a side slot.

In U.S. Pat. No. 3,847,193, issued Nov. 12, 1974 to F. H. Brunstetter, there is disclosed an elongated tool having a concave cavity at the forward end thereof. This cavity is covered by a flexible sleeve 30 which has an aperture therein surrounded by circumferentially spaced flaps. In use, the nail head is inserted past the flaps, through the aperture and into the cavity. The outer end of the tool is then struck by a hammer, to cause the tool to drive the nail. When the nail is partially driven, the tool is removed and the nail head exits through the aperture and past the flaps.

In U.S. Pat. No. 3,946,779, issued Mar. 30, 1976 to D. H. Sudol, there is disclosed a simple foam plug having a side slot therein. The nail is inserted into the plug through the slot, is partially driven home, and the plug is then removed by withdrawing the nail back through the slot.

In U.S. Pat. No. 4,004,624, issued Jan. 25, 1977 to F. W. Holstein, there is disclosed a flexible strap having a aperture therein, into which a nail can be inserted and held in position while it is partially driven. Thereafter, a nail set is used to drive the nail completely home.

In U.S. Pat. No. 4,483,923, issued Jul. 4, 1989 to R. G. Voss, there is disclosed a flexible nail holder having an end slot and a nail receiving hole. When the nail is partially driven, the holder is withdrawn and the nail exits through the end slot.

In U.S. Pat. No. 5,671,641, issued Sep. 30, 1997 to R. E. Stephenson, Jr., a nail holder is formed of a flat foam block having a edge slit therein which can hold a nail being driven. When the nail is partially drive, the holder is withdrawn and the nail exits through the slit.

While all of these nail holders offered an improvement over simply holding the nail by hand while it is being hammered, they all still had certain disadvantages. Some of the prior art units had slits or slots through which the nail could exit, requiring that the operator hold the nail holder exactly in position or else the nail would escape from the holder. Other prior art devices consisted of easily moveable holders, like a block of foam or a flexible strap, and these devices likewise presented the user with the difficult task of holding the device in the exact position while the nail was being driven. Still other prior art devices consisted of expensive tools which were expensive to manufacture and maintain. Any many of the prior art devices were simply too complicated to permit easy use by children, who might be tempted to try their hand at carpentry or woodworking.

OBJECTS OF THE INVENTION

With the foregoing in mind, it is therefore an object of the present invention to overcome the difficulties, shortcomings, and disadvantages of the prior art nail holder devices and to provide instead a new and improved form of nail holder device.

Another object of the present invention is to provide a nail holder device which is simple to operate and which can be used by children without substantial training time.

Another object of the present invention is to provide a nail holder device which is inexpensive to produce and which will operate for extended periods without undue maintenance.

Another object of the present invention is to provide a holder for fasteners other than nails, e.g., screws, as well as for nails.

Other objects, advantages and salient features of the present invention will become apparent from the following detailed description, which, taken in conjunction with the annexed drawings, discloses a preferred embodiment thereof.

SUMMARY OF THE INVENTION

The present invention consists of a fastener or nail holder consisting of a handle portion having an upper and a lower end and a head portion attached to the handle portion at its upper end. The head portion includes a body section having opposed side and end walls and a transverse bore extending entirely through the body section from one side wall to the other. The body section also includes an elastomeric band which surrounds the body section by wrapping around the body section and thereby overlying and extending across the side walls and end walls. As such, the elastomeric band also extends across and covers the open ends of the transverse bore.

The elastomeric band has two apertures formed therein, one in each side portion of the band which extends across and covers the bore. The apertures are aligned with one another at opposite ends of the bore. As such, there is a passage formed through one aperture, through the bore, and out the other aperture, and this passage is intended for receiving and holding a nail or fastener to be driven into an underlying surface.

The handle portion of the holder is offset from the head portion to permit the user to grasp and hold the device next to the underlying surface in a manner wherein the body section and overlying band is directly adjacent to the underlying surface.

In use, the user inserts a nail or fastener through both apertures, where it is held in position while a portion of its length extends through the bore. By holding the handle and positioning the head portion next to the underlying surface, the point on the nail or end on the fastener is directly next to the surface. While continuing to hold the device with one hand, the user starts to hammer the nail or secure the fastener with the other hand, thereby causing it to penetrate the underlying surface. When the nail or fastener is partially driven, such that the head end of the nail or fastener is at or approaching the outer aperture in the band, the device is removed by withdrawing it away from the underlying surface. Since the band is fabricated of elastomeric material, the portion which forms the edges of the apertures stretches enough to permit the nail or fastener head to pass therethrough. Once the device is entirely removed, the partially driven nail or fastener can be driven all the way into the underlying surface.

BRIEF DESCRIPTION OF THE DRAWINGS

Referring now to the drawings, which form a part of this original disclosure.

DETAILED DESCRIPTION OF THE INVENTION

Figure 1:
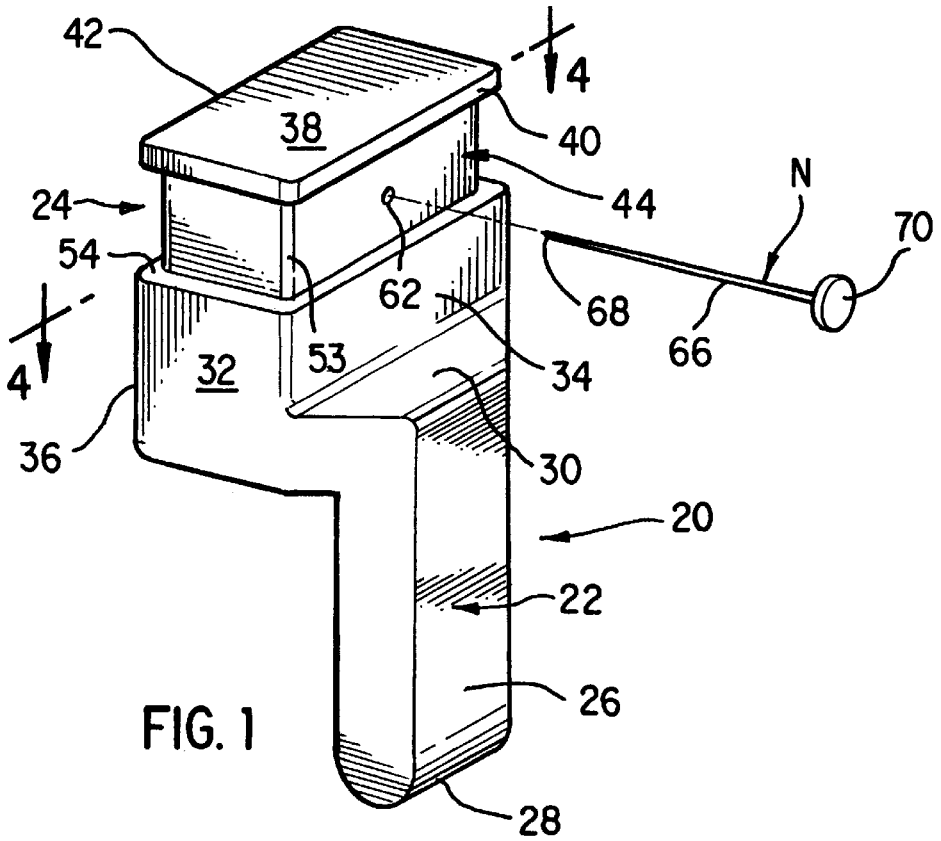
FIG. 1 is a perspective view of a fastener holder device in accordance with the principles of my invention.

Referring now to the drawings in greater detail, FIG. 1 shows a fastener holder device generally designated 20 in accordance with the principles of the present invention. The device 20 consists of a handle portion generally designated 22 and a head portion generally designated 24.

Figure 2:
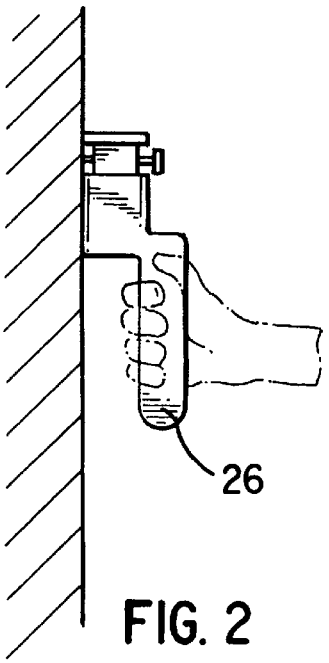
FIG. 2 is a side elevational view, showing how the device is positioned in use.

The handle consists of an axially elongated gripping portion 26 which extends from a lower end 28 toward the head portion 24. At a point beyond its mid-point, the handle 26 is transversely offset by means of portion 30 which is generally perpendicular to the gripping portion 26. The offset portion 30 also can be of wider dimension than the gripping portion since it is not intended to be hand-held. As best seen in FIG. 2, the handle gripping portion 26 is configured so as to accommodate and be held by the clenched grip of a hand.

The offset portion 30 of the handle portion merges into the lower section 32 of the device head portion 24. The lower section 32 includes spaced parallel outer and inner walls 34 and 36, respectively, which are also parallel to the handle portion 22. The outer wall 34 extends upward from the offset portion 30 of the handle, while the inner wall 36 forms the inner surface of the lower section 32.

The head portion 24 also includes an upper section 38 which has the same cross-sectional configuration as the lower section 36. Thus, the upper section 38 has outer and inner walls 40 and 42 which respectively, are coplanar with, but spaced above, the corresponding walls 34 and 36 on the lower section 32.

A body section generally designated 44 forms the center part of the head portion 24. The body section is located between the lower and upper sections 32 and 38, respectively. As can best be seen from FIG. 4, the body section 44 has opposed outer and inner side walls 46 and 48, respectively, interconnected by spaced parallel end walls 50, 52. The side and end walls of the body section are parallel to, but spaced inwardly from, the corresponding walls on the lower section 32, thereby creating a continuous shoulder 54 at the intersection of the body section 44 and lower section 32 of the head portion. It will be understood that a similar shoulder, not fully illustrated, is formed at the intersection of the body section 44 and the top section 38 of the head portion 44. The purpose of the shoulders is to provide a guidance groove for an elastomeric band, described hereinafter.

The body section 44 is itself formed as a solid body 56 which is generally rectangular in cross-sectional configuration. A cylindrical bore 58 extends completely through the body 56 from and between the outer wall 46 and inner wall 48. The elevational location of the bore 58 is approximately midway between the lower and upper sections 32 and 38 of the head portion.

The device 20 includes an elastomeric band 60, formed of rubber or like material, which completely surrounds the body section 44 and which thus has side portions which are juxtaposed to, and in contact with, the side walls 46 and 48, and the end walls 50 and 52, of the body section. The elastomeric band has a cross-sectional configuration no greater than that of the body 56, and perhaps slightly smaller, to ensure that it adheres tightly against the side and end walls of the body. The band 60 thus covers and extends over the open ends of the bore 58.

Figure 4:
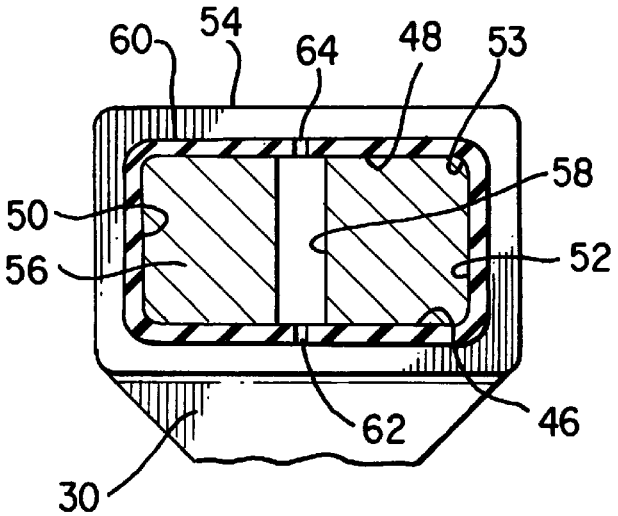
FIG. 4 is a transverse sectional view taken along the lines 4—4 of FIG. 1.

An aperture is formed in each of the band's side walls in alignment with the bore 58. Thus, an aperture 62 is formed in the outer wall portion of the band 60 and a corresponding aperture 64 is formed in the inner wall portion of the band. The apertures 62 and 64 are aligned with one another and are also aligned with the central axis of the bore 58. The presence of the shoulder 54 and its opposed (but unnumbered) shoulder is to provide a guidance channel or groove for the elastomeric band 60 in order to assure that the apertures 62 and 64 are in alignment. Also, the comers of the body section 44 are chamfered where the side walls 46, 48 meet the end walls 50, 52 to provide a further guide for the elastomeric band 60. These chamfers are designated 53, as shown in FIGS. 1 and 4.

The device 20 is employed by a user to assist in holding a fastener, such as a nail designated N, which has an elongated body or shank portion 66 having a pointed end 68 at one end thereof and a head 70 at the opposite end thereof. The device 20 can also be used with screws, with elongated pins, or with other forms of fasteners which, like nails, have elongated bodies or shanks.

Figure 5:
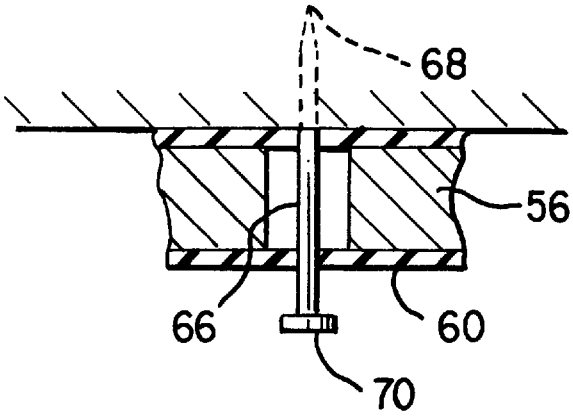
FIG. 5 is a fragmentary sectional view showing the device in use.

In use, the device is positioned next to an underlying surface into which the nail N is to be driven, as, for example, a wall. The device is held as shown in FIG. 2, with the user grasping and gripping the handle portion 26 and the inner walls 36 and 42 of the head portion in contact against the surface. The pointed end 68 of the nail in digitally inserted through the outer aperture 62, through the bore 60 and into the inner aperture 64. This procedure holds the nail in position, as the portion of the elastomeric material of the band 60 which forms the periphery of the apertures 62 and 64 holds the nail shank in place. The user then takes a hammer of other driving instrument and hammers against the head 70 of the nail, causing the pointed end to penetrate the underlying surface, as shown in FIG. 5, and to start to be held in place by insertion of a part of the shank portion into the wall or other underlying surface.

Figure 6:
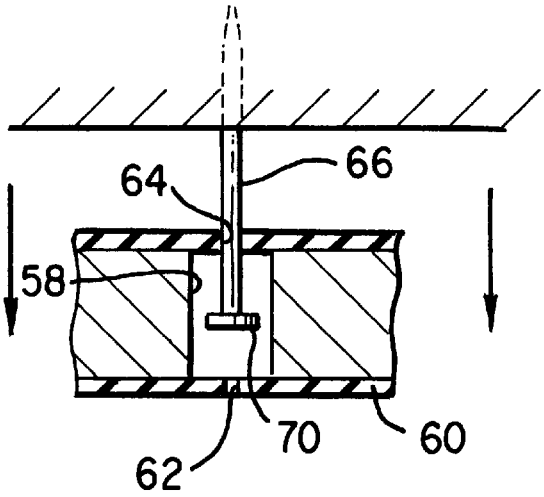
FIG. 6 is a fragmentary sectional view, similar to FIG. 5, showing the device being removed from use.
Figure 3:
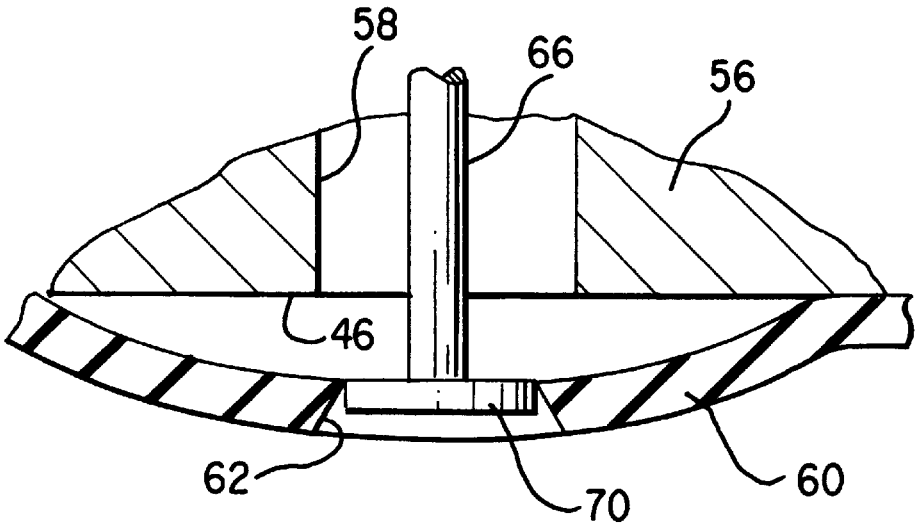
FIG. 3 is an enlarged fragmentary sectional view showing a portion of the device in use.

Prior to the time when the head 70 of the nail N reaches the band 60, the user stops hammering. The nail N is now firmly in position, since it is partially inserted into the wall. At this point, the user withdraws the device 20 away from the wall or underlying surface, as shown in FIG. 6. In order to achieve such withdrawal successfully, the nail head 70 must pass through the apertures 62 and 64 of the band 60, and through the bore 58 of the body section. As shown in FIG. 3, the edges of the aperture 62 are stretched outwardly to permit passage of the nail head 70. Perhaps even the band 60 is stretched slightly away from contact with the body walls, but the band elastically recovers its original position once the head passes through the aperture. Exactly the same thing happens as the nail head 70 passes through the aperture 64.

The cross-sectional diameter of the bore 58 is considerably in excess of the cross-sectional diameter of the apertures 62 and 64 in the band 60, since the material forming the apertures can stretch outwardly to accommodate passage of the nail head 70, while the bore 58 is not stretchable and thus must have enough width the permit passage of the nail head 70.

The elastomeric material which forms the band 60 is both deformable, as perviously discussed, and elastically recoverable. After the device has been used for a considerable period of time, it is possible that the band portion forming the periphery of the apertures may become partially deformed or stretched out so badly that full elastic recovery no longer occurs. This condition, in turn, would mean that the nail N is held in position loosely rather than tightly. To remedy this situation, it is possible to simply remove the old band 60 and replace it with a new band.

After reading the foregoing detailed description, it should be apparent that the objects set forth at the outset hereof have been successfully achieved by the present invention. Various changes and modifications apparent to those skilled in the art may be made without departing from the spirit and scope of the present invention as defined in the appended claims.

What is claimed is:

1. A device for holding a fastener in position to facilitate penetration of the fastener into an underlying surface, said device comprising:

a holder consisting of a handle portion having an upper and lower end and a head portion attached to the handle portion at the upper end thereof;

said head portion including:

a body section having opposed side and end walls, a transverse bore extending entirely through the body section from one side wall to the other; and an elastomeric band surrounding said body section;

said elastomeric band having side portions extending across the side walls of said body section to thereby extend across and cover said transverse bore;

said elastomeric band having apertures formed therein, with one aperture being formed in each side portion of the band which extends across said bore;

said apertures being aligned with one another at opposite ends of said bore;

said device being operable by grasping the handle with one hand and positioning the head portion adjacent to the underlying surface while inserting the fastener into and through the aligned apertures and bore with the other hand;

said device being removable after the fastener has partially penetrated the underlying surface by manually withdrawing the head portion away from the underlying surface, to cause the extending portion of the fastener to pass through the apertures in the band.

2. A device as defined in claim 1 wherein said handle is elongated along a central axis and wherein said head portion is offset from said axis.

3. A device as defined in claim 1 wherein the cross-sectional diameter of said bore is substantially greater than the cross-section diameter of said apertures.

4. A device as defined in claim 1 wherein said band and said apertures in said band are deformable to enable a nail head to pass through said apertures.

5. A device as defined in claim 1 wherein said band's elastomeric properties enable it to recover its original configuration after deformation is completed.

6. A device as defined in claim 1 wherein the fastener is a nail.

7. A device as defined in claim 1 wherein the fastener is a screw.

* * * * *